US005778774A

United States Patent [19]

Lavoie

[11] Patent Number: 5,778,774

[45] Date of Patent: Jul. 14, 1998

[54] ARTICULATING EMBOSSING DIE

[75] Inventor: Raymond G. Lavoie, Manchester, N.H.

[73] Assignee: Framatome Connectors USA Inc., Fairfield, Conn.

[21] Appl. No.: 768,431

[22] Filed: Dec. 18, 1996

[51] Int. Cl.[6] ..... B31F 1/07; B41J 11/20

[52] U.S. Cl. ..... 101/28; 101/31.1; 400/55; 400/58

[58] Field of Search ..... 101/18, 21, 26, 101/27, 28, 29, 30, 31, 31.1; 400/55, 58, 127, 134.4

[56] References Cited

U.S. PATENT DOCUMENTS

| | | | |
|---|---|---|---|
| 591,473 | 10/1897 | Howe | 101/28 |
| 1,368,169 | 2/1921 | Leonard et al. | 101/18 |
| 1,695,582 | 12/1928 | Glass et al. | 101/DIG. 31 |
| 1,779,091 | 10/1930 | Glass | 101/27 |
| 1,798,655 | 3/1931 | Brugiere | 101/28 |
| 1,968,886 | 8/1934 | Glass | 101/31 |
| 2,896,530 | 7/1959 | Bernard | 101/4 |
| 3,063,364 | 11/1962 | Kahlen | 101/28 |
| 3,191,525 | 6/1965 | Challen et al. | 101/4 |
| 3,620,159 | 11/1971 | Gould | 101/28 |
| 4,792,376 | 12/1988 | Denley | 156/540 |
| 4,942,757 | 7/1990 | Pecora | 72/453.16 |

FOREIGN PATENT DOCUMENTS

| | | | |
|---|---|---|---|
| 0 118 914 A2 | 9/1984 | European Pat. Off. | 101/28 |

OTHER PUBLICATIONS

"Hyground Systems Installation Procedure", Framatome Connectors International, 5 pages.

*Primary Examiner*—Edgar S. Burr
*Assistant Examiner*—Amanda B. Sandusky
*Attorney, Agent, or Firm*—Perman & Green, LLP

[57] ABSTRACT

A compression tool embossing die having a frame and a movable embossing pad. The frame has a U-shaped member and two side plates attached to opposite ends of the U-shaped member. The side plates have slots therein. The embossing pad has an embossing pad member, a dowel and a backstop. The dowel has its ends movably located in the slots of the side plates. The pad member has two wedge shaped slots in its bottom surface. The die further comprises two springs located in the wedge shaped slots and biasing the embossing pad at a first position on the frame.

21 Claims, 3 Drawing Sheets

ARTICULATING EMBOSSING DIE

BACKGROUND OF THE INVENTION

1. Field of The Invention

The present invention relates to embossing and, more particularly, to an embossing die for use with a compression tool.

2. Prior Art

U.S. Pat. No. 4,942,757 discloses a hydraulic compression tool that removably receives dies in the C-shaped head. Embossing die kits, such as the BURNDY electrical PIBEW and PIBES P1 pre-crimp die kits, have been used with compression tools in the past. BURNDY, PIBEW and PIBES are trademarks of Framatome Connectors USA Inc.

SUMMARY OF THE INVENTION

In accordance with one embodiment of the present invention a compression tool embossing die is provided comprising a frame and embossing pad. The frame has a general U-shaped member with retaining surfaces on opposite exterior sides at the top of legs of the general U-shape. The general U-shaped member also comprises a bottom surface with a lock pin receiving recess for receiving a position locking pin of the compression tool extending into the die receiving seat. The embossing pad is pivotally mounted to and spring loaded on the frame.

In accordance with another embodiment of the present invention a compression tool embossing die is provided comprising a frame, an embossing pad, and a spring. The frame comprises a U-shaped member and two side plates attached to opposite ends of the U-shaped member. The two side plates have slots therein. The embossing pad is pivotally mounted to the frame and has portions extending into the slots. The portions are moveable inside the slots. The spring is located between the U-shaped member and the embossing pad to bias the pad at a home position with the portions of the pad at first ends of the slots in the side plates.

In accordance with another embodiment of the present invention, a compression tool embossing die is provided comprising a frame, an embossing pad, and two springs. The embossing pad is movable mounted to the frame. The two springs are located between the frame and the embossing pad. The springs bias the embossing pad at a first position on the frame. The embossing pad is pivotable on the frame and, the embossing pad is movable on the frame from the first position to a second position, with compression of springs, for a bottom of the embossing pad to contact the frame.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
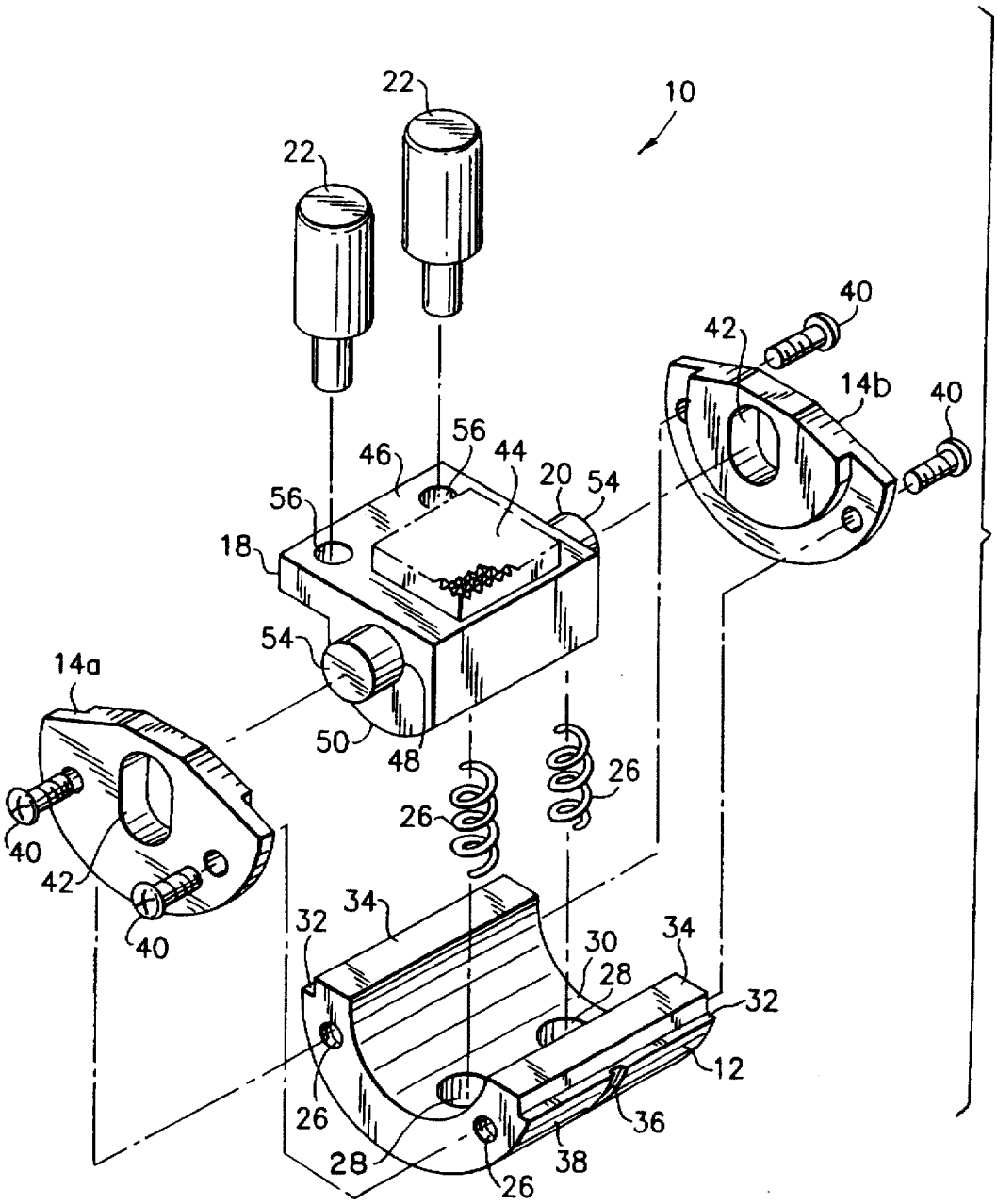
FIG. 1 is an exploded perspective view of an embossing die assembly incorporating features of the present invention.

Referring to FIG. 1, there is shown an exploded perspective view of an embossing die assembly 10 incorporating features of the present invention. Although the present invention will be described with reference to the single embodiment shown in the drawings, it should be understood that features of the present invention can be embodied in various different forms of alternate embodiment. In addition, any suitable size, shape or type of elements or materials could be used.

The embossing die assembly 10 generally comprises a frame and an embossing pad. The frame includes a U-shaped base member 12 and two side sections **14*a*, 14*b* formed by individual plates 14 (see also FIGS. 2–3). The embossing pad generally comprises an embossing pad member 18, a dowel 20, and two backstop pins 22. The assembly 10, in the embodiment shown, also comprises two coil springs 26**.

The base member 12 is a one-piece member preferably made of metal. However, in alternate embodiments, the base member could be comprised of multiple members. The base member 12 has screw holes 26 on its side ends, spring seats 28 in its inner surface 30, retaining ledges 32 along the top of the legs 34 that form the U-shape, and a groove 36 along a center of the bottom surface 38. The shape of the base member 12, including the ledges 32 and groove 36, is suitably configured to be mounted in a working head of a compression tool, such as described in U.S. Pat. No. 4,942,757 which is hereby incorporated by reference in its entirety.

The groove 36 forms a lock pin receiving recess for receiving a position locking pin of the compression tool. The base member 12 is shaped to be slid into a die receiving seat of the compression tool with the ledges 32 contacting die retaining ridges of the die receiving seat. The two side plates 14 are fixedly attached to the side ends of the base member 12 by the screws 40. The side plates 14 each have an elongate slot 42. In alternate embodiments, other shapes and types of frames could be provided and, they could be configured to be removably mounted in any suitable type of compression tool. The side sections **14*a*, 14*b*** could be formed integral with the rest of the frame.

Figure 2:
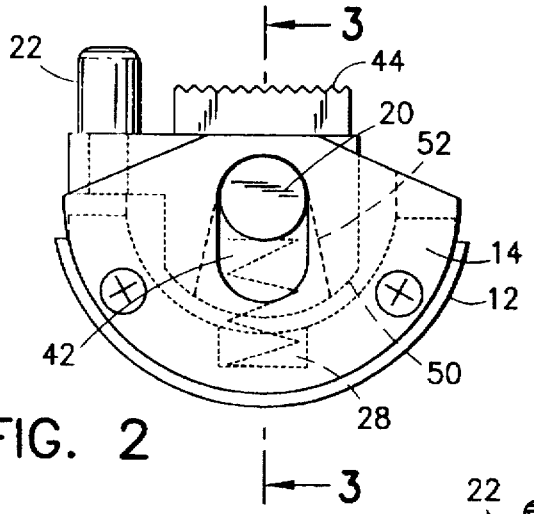
FIG. 2 is an elevational side view of the embossing die shown in FIG. 1.
Figure 3:
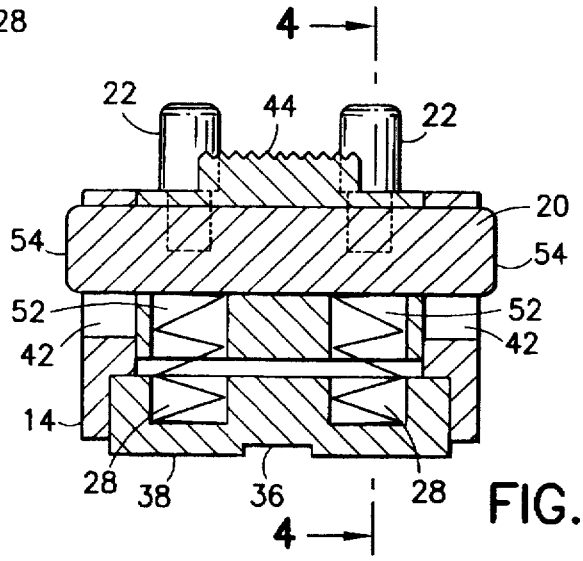
FIG. 3 is a cross sectional view of the embossing die shown in FIG. 2 taken along line 3—3.
Figure 4:
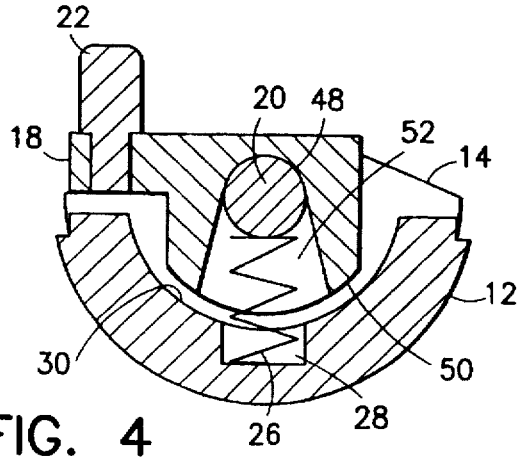
FIG. 4 is a cross sectional view of the embossing die shown in FIG. 3 taken along line 4—4.

The embossing pad member 18 has a top surface with an embossing surface 44, a ledge 46 on a back side, a hole 48 between its two side ends, and a curved bottom surface 50. Referring also to FIGS. 2–4, the embossing pad member 18 has two wedge shaped slots 52. The slots 52 extend from the curved bottom surface 50 to the hole 48. The dowel 20 is stationarily located in the hole 48. Ends 54 of the dowel 20 extend outward past the side ends of the embossing pad member 18. In an alternate embodiment, multiple dowels could be used; one at each side end of the embossing pad member 18. Alternatively, the ends 54 could be integrally formed with the embossing pad member 18. The ledge 46 on the back side of the embossing pad member 18 has two holes 56. The two pins 22 are stationarily mounted in the two holes 56.

The ends 54 of the dowel 20 extend into the two slots 42 of the two side plates 14. The ends 54 form pivot sections for the embossing pad to pivot relative to the frame. The two springs 26 each have one end located in a spring seat 28 and an opposite end in the wedge shaped slot 52 against the dowel 20. In an alternate embodiment, more or less than two springs could be provided. In addition, any suitable type of springs or spring configuration could be provided. The two springs 26 bias the dowel 20 and the embossing pad member 18 in an upward direction away from the base member 12. However, because the ends 54 of the dowel 20 are located in the slots 42, and the side plates 14 are stationarily mounted to the base member 12, the side plates 14 stop the upward movement of the embossing pad member 18.

Figure 5:
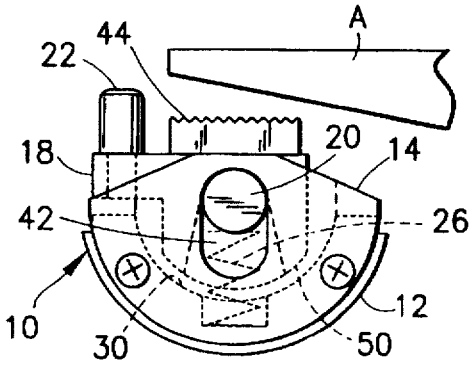
FIG. 5 is a schematic elevational side view of the embossing die as shown in FIG. 2 shown with a member intended to be embossed.
Figure 8:
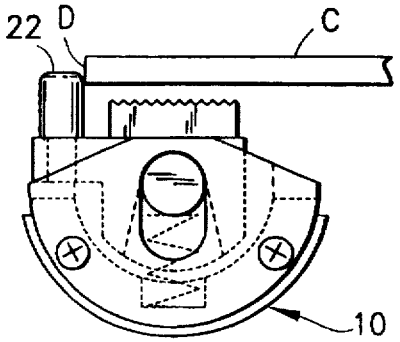
FIG. 8 is an elevational side view of the embossing die as shown in FIG. 5 with a second different member intended to be embossed.
Figure 6:
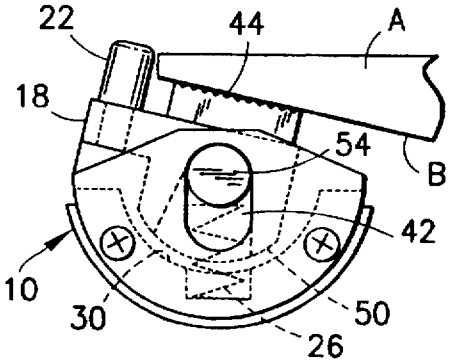
FIG. 6 is an elevational side view as in FIG. 5 showing the embossing die making first contact with the member intended to be embossed.
Figure 9:
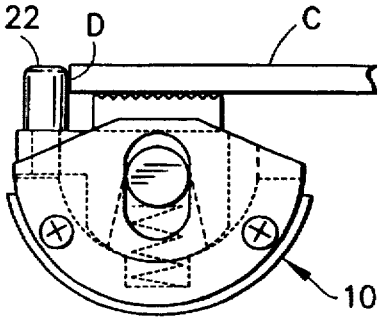
FIG. 9 is an elevational side view as in FIG. 8 showing the bottom of the embossing pad contacting the frame of the embossing die.
Figure 7:
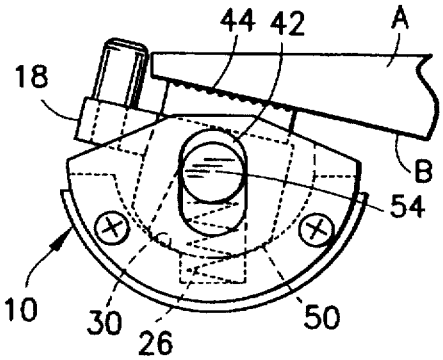
FIG. 7 is an elevational side view as in FIG. 6 showing the bottom of the embossing pad contacting the frame of the embossing die.

The embossing pad can both pivot relative to the frame and vertically move relative to the frame. Referring to also FIGS. 5–7, a member A intended to be embossed is shown. As seen best in FIGS. 4 and 5, during a normal unloaded state, the assembly 10 has the curved bottom surface 50 of the embossing pad member 18 spaced from the inner surface 30 of the base member 12. The ends 54 of the dowel 20 are biased against the top of the slots 42. When the assembly 10 is moved into contact with the member A, as seen in FIG. 6, the embossing pad is able to pivot at the ends 54 and slots 42. This allows the embossing surface 44 to be aligned or moved parallel with the surface B of the member A intended to be embossed. The wedge shape of the slots 52 prevents the pivoting movement to interfere with the springs 26. In an alternate embodiment, the slots 52 need not be wedge shaped. However, the slots should be shaped to provide clearance such that the embossing pad can pivot without interfering with the operation of the springs and vise versa. When the assembly 10 is moved closer to the member A, the springs 26 compress and the two surfaces 30, 50 contact each other. Because the two surfaces 30, 50 now contact each other, force sufficient to cause embossing of the surface B by the surface 44 can now be transmitted from the base member 12 directly to the embossing pad member 18. When the assembly 10 is moved away from the member A, the springs 26 return the embossing pad to its extended normal unloaded position on the frame. Referring also to FIGS. 8 and 9, the assembly 10 can also be used to emboss substantially flat articles, such as plate C. The pins 22 project upward past the embossing surface 44. The pins 22 act as a backstop to prevent an article from being inserted too far into the compression tool and, insure that the area of the article being embossed is at a predetermined distance from the leading edge D of the article. In an alternate embodiment, the pins 22 could be replaced with any suitable type of backstop. Alternatively, a backstop need not be provided.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A compression tool embossing die comprising:

a frame;

an embossing pad movably mounted to the frame by a connection, the connection between the frame and the embossing pad including the frame and the embossing pad having slots and pivot sections located in the slots such that the pivot sections can vertically and rotationally move in the slots to allow the embossing pad to vertically and rotationally move relative to the frame; and a spring between the frame and the embossing pad, the spring biasing the embossing pad in an upward direction away from a base of the frame towards a first position on the frame;

wherein the embossing pad is pivotable on the frame and, the embossing pad is movable on the frame from the first position to a second position, with compression of the spring, for a bottom of the embossing pad to contact the frame.

2. A die as in claim 1 wherein the frame includes a U-shaped member having two side plates attached to opposite ends thereof.

3. A die as in claim 2 wherein the side plates have the slots therein and the embossing pad has the pivot sections that project into the slots.

4. A die as in claim 3 wherein the embossing pad comprises a first embossing pad member and a dowel connected to the embossing pad member, the dowel having ends extending past ends of the embossing pad member and forming the pivot sections that project into the slots.

5. A die as in claim 4 wherein the embossing pad further comprises a backstop connected to one side of the embossing pad member that projects upward past an embossing surface of the embossing pad member.

6. A compression tool embossing die comprising:

a frame comprising an embossing pad receiving area and two side sections on opposite sides of the receiving area, the two side sections each having a slot therein;

an embossing pad located, at least partially, in the embossing pad receiving area, the embossing pad being pivotably mounted to the frame with portions extending into the slots in the side sections of the frame; and a spring located between the frame and the embossing pad to bias the pad at a home position with the portions of the embossing pad being located at first ends of the slots in the side sections.

7. A die as in claim 6 wherein the embossing pad comprises an embossing pad member and a dowel connected to the embossing pad member, the dowel having ends extending past ends of the embossing pad member and forming the portions that project into the slots of the side plates.

8. A die as in claim 6 wherein the embossing pad further comprises a backstop at one side of the embossing pad that projects upward past an embossing surface of the pad.

9. A die as in claim 8 wherein the embossing pad includes an embossing pad member with the embossing surface thereon and the backstop includes two pins attached to the embossing pad member.

10. A die as in claim 6 wherein the embossing pad includes a wedge shaped slot extending into its bottom surface, wherein the spring is located in the wedge shaped slot and contacts an inner surface of the frame.

11. A die as in claim 10 wherein the embossing pad has two of the wedge shaped slots and two of the springs located in the slots.

12. A compression tool embossing die comprising:

a frame having a general U-shaped member with retaining surfaces on opposite exterior sides at the top of legs of the general U-shape member sized and shaped for contacting die retaining ridges of a die receiving seat in a compression tool, and a bottom surface with a lock pin receiving recess for receiving a position locking pin of the compression tool extending into the die receiving seat; and an embossing pad pivotally mounted to and spring loaded on the frame.

13. A die as in claim 12 wherein the lock pin receiving recess is a groove along a center of the bottom surface and the retaining surfaces extend along the top of the legs as ledges.

14. A die as in claim 12 wherein the frame has two side plates attached to opposite ends of the U-shaped member.

15. A die as in claim 14 wherein the side plates have slots therein and the embossing pad has pivot sections that project into the slots.

16. A die as in claim 15 wherein the embossing pad comprises a first embossing pad member and a dowel connected to the embossing pad member, the dowel having ends extending past ends of the embossing pad member and forming the pivot sections that project into the slots.

17. A die as in claim 12 wherein the embossing pad further comprises a backstop at one side of the embossing pad that projects upward past an embossing surface of the pad.

18. A die as in claim 17 wherein the embossing pad includes an embossing pad member with the embossing surface thereon and the backstop includes two pins attached to the embossing pad member.

19. A die as in claim 12 wherein the embossing pad includes a wedge shaped slot extending into its bottom surface and a spring located in the wedge shaped slot and contacting an inner surface of the U-shaped member of the frame.

20. A die as in claim 19 wherein the embossing pad has two of the wedge shaped slots and two of the springs located in the slots and contacting the inner surface of the U-shaped member.

21. An embossing die assembly comprising:

a frame having a base member with an inner surface;

an embossing pad member having a curved bottom surface, the embossing pad member being connected to the frame to both pivot relative to the frame and also vertically move relative to the frame; and at least one spring biasing the embossing pad member in an upright direction away from the base member at a position where the curved bottom surface is spaced from the inner surface of the frame, wherein the bottom surface of the embossing pad member and the inner surface of the frame directly contact each other upon the spring being compressed.

* * * * *